US007583024B2

(12) United States Patent
Chen et al.

(10) Patent No.: US 7,583,024 B2
(45) Date of Patent: Sep. 1, 2009

(54) DOUBLE-FACED PLASMA DISPLAY PANEL

(75) Inventors: Pi-Jin Chen, Beijing (CN); Peng Liu, Beijing (CN); Li Qian, Beijing (CN); Yang Wei, Beijing (CN); Lei-Mei Sheng, Beijing (CN); You-Hua Lei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 282 days.

(21) Appl. No.: 11/115,467

(22) Filed: Apr. 27, 2005

(65) Prior Publication Data

US 2005/0280366 A1 Dec. 22, 2005

(30) Foreign Application Priority Data

Jun. 16, 2004 (CN) ..... 2004 1 0027755

(51) Int. Cl.
*H01J 17/49* (2006.01)

(52) U.S. Cl. ..... 313/582

(58) Field of Classification Search ..... None
See application file for complete search history.

(56) References Cited

U.S. PATENT DOCUMENTS 5,304,895 A * 4/1994 Ujihara ..... 315/72
5,357,355 A * 10/1994 Arai ..... 349/69
6,320,313 B1 * 11/2001 Yoo et al. ..... 313/582
6,697,083 B1 * 2/2004 Yoon ..... 345/658
6,703,772 B2 3/2004 Hasegawa et al.

FOREIGN PATENT DOCUMENTS

JP 2003/177683 * 6/2003

OTHER PUBLICATIONS

IBM TDB, "Dual Face Plasma Display Device", Fischer et al.; Dec. 1, 1982.*

* cited by examiner

*Primary Examiner*—Toan Ton
*Assistant Examiner*—Britt Hanley

(57) ABSTRACT

A double-faced plasma display panel includes two parallel viewing screens (20, 20'), and a discharge structure (30) located between the viewing screens. Each viewing screen includes a transparent substrate (21, 21'), with a plurality of transparent electrodes (23, 24, 23', 24'), a transparent dielectric layer (22, 22'), and a protection layer (25, 25') formed at an inner surface of the transparent substrate. The discharge structure includes an opaque insulative substrate (31), with a plurality of addressing electrodes (37, 37'), an opaque dielectric layer (38, 38'), a plurality of separation walls (39, 39'), and a fluorescent layer (40, 40') formed at each of opposite surfaces (310, 310') thereof. Symmetrically opposite pairs of same electrodes are electrically interconnected so that the viewing screens can simultaneous display a same image. Only a single driving system is needed to achieve the simultaneous display.

15 Claims, 3 Drawing Sheets

DOUBLE-FACED PLASMA DISPLAY PANEL

BACKGROUND OF THE INVENTION

1. Field of the Invention

The invention relates generally to double-faced display devices, and more particularly to a kind of double-faced plasma display panel.

2. Prior Art

A plasma display panel is a thin flat screen display device having a large screen size. In use, electrons are accelerated by an electric field so that the accelerated electrons collide with a discharge gas. This causes excitation of the discharge gas and subsequent remission. The remission process causes radiation of ultraviolet rays. The ultraviolet rays irradiate a fluorescent material, whereby the ultraviolet rays are converted into visible light.

FIG. 5 is an isometric view of part of a conventional plasma display panel 1. The plasma display panel 1 comprises a transparent substrate 11 and an opaque substrate 12. A plurality of scanning electrodes 14 and a plurality of displaying electrodes 13 are alternately arranged on an inner surface of the transparent substrate 11, and are each aligned in a first horizontal direction. A transparent dielectric layer 15 covers the scanning electrodes 14 and the displaying electrodes 13, so that the scanning electrodes 14 and the displaying electrodes 13 are embedded in the transparent dielectric layer 15. A protection layer 16 covers the transparent dielectric layer 15. A plurality of addressing electrodes 17 are arranged on an inner surface of the opaque substrate 12, and are each aligned in a second horizontal direction. The second horizontal direction is perpendicular to the first horizontal direction, and the inner surface of the opaque substrate 12 is opposite to the inner surface of the transparent substrate 11. An opaque dielectric layer 18 covers the addressing electrodes 17, so that the addressing electrodes 17 are embedded in the opaque dielectric layer 18. A plurality of separation walls 19 extend up from the opaque dielectric layer 18, the separation walls 19 each being aligned in the second horizontal direction. Each separation wall 19 generally separates two adjacent addressing electrodes 17. A fluorescent layer 10 is coated on exposed regions (not labeled) of the opaque dielectric layer 18 and side faces (not labeled) of the separate walls 19. The fluorescent layer 10 comprises three primary colors, such as red, green and blue. A discharge gas is filled within a discharge space 168 defined between the protection layer 16 and the opaque dielectric layer 18.

When a voltage applied between the displaying electrodes 13 and the scanning electrodes 14 is more than the starting voltage, the discharge gas in the discharge space 168 discharges and generates ultraviolet rays. The ultraviolet rays irradiate the fluorescent layer 10, and the fluorescent layer 10 luminesces in accordance with the three primary colors. Thus visible light is emitted from an outer surface of the transparent substrate 11.

U.S. Pat. No. 6,703,772 discloses a similar kind of plasma display panel. In such plasma display panel, an image is only displayed on an outer surface of the transparent substrate, and cannot be displayed on an outer surface of the opaque substrate. However, in certain applications, the plasma display panel is required to simultaneous display images at two opposite sides thereof. Generally, a pair of such plasma display panels are adopted to form a double-faced plasma display panel assembly. The opaque substrates of the plasma display panels are engaged with each other. In such kind of double-faced plasma display panel assembly, two driving systems are needed. Furthermore, the structure of the double-faced plasma display panel assembly is complicated. Thus, the double-faced plasma display panel assembly is bulky and expensive.

A double-faced plasma display panel which overcomes the above-mentioned problems is desired.

SUMMARY OF THE INVENTION

Accordingly, an object of the present invention is to provide a double-faced plasma display panel having a simple structure, a small size, and a low cost.

To achieve the above-mentioned object, the present invention provides a double-faced plasma display panel comprising two parallel viewing screens and a discharge structure located between the viewing screens. Each viewing screen comprises a transparent substrate with a plurality of transparent scanning electrodes, a plurality of transparent displaying electrodes, a transparent dielectric layer and a protection layer formed at an inner surface of the transparent substrate. The scanning electrodes and the displaying electrodes are alternately arranged on the inner surface of the transparent substrate, and are each aligned in a first horizontal direction. The transparent dielectric layer covers the transparent scanning electrodes and the transparent displaying electrodes. The protection layer covers the transparent dielectric layer.

The discharge structure comprises an opaque insulative substrate having two opposite surfaces. Each surface generally faces the corresponding viewing screen. A plurality of addressing electrodes, an opaque dielectric layer, a plurality of separation walls and a fluorescent layer are formed at each surface of the opaque insulate substrate. The addressing electrodes are arranged on the surface, and are each aligned in a second horizontal direction, which is perpendicular to the first horizontal direction. The opaque dielectric layer covers the addressing electrodes. The separation walls are formed at the opaque dielectric layer and are each aligned in the second horizontal direction. Each separation wall generally separates two adjacent addressing electrodes. The fluorescent layer is coated on exposed regions of the opaque dielectric layer and side faces of the separate walls. The fluorescent layer comprises three primary colors, such as red, green and blue.

Each protection layer and the corresponding opaque dielectric layer cooperatively define a discharge space. A discharge gas is filled within discharge spaces. The discharge gas is selected from the group consisting of helium gas, neon gas, xenon gas, argon gas, and any mixture thereof.

When the scanning electrodes and the displaying electrodes are regarded as the row electrodes, the addressing electrodes are regarded as the column electrodes. Conversely, when the addressing electrodes are regarded as the row electrodes, the scanning electrodes and the displaying electrodes are regarded as the column electrodes. Each pair of row electrodes which are symmetrical to the opaque insulative substrate are electrically interconnected. Each pair of column electrodes which are axially symmetrical to a center of the opaque insulate substrate are electrically interconnected. Furthermore, a single driving system is applied in the plasma display panel to achieve simultaneous display images at the two viewing screens.

Compared with a conventional plasma display panel, the plasma display panel of the present invention adopts a pair of viewing screens and a single driving system to simultaneously display same images at the two viewing screens. Therefore, the plasma display panel has a simple structure, a small size, and a low cost. This enables the plasma display panel to be advantageously applied in traffic signal boards, large-scale display boards, surround cinemas and so on.

Other objects, advantages and novel features of the invention will become more apparent from the following detailed description when taken in conjunction with the accompanying drawings, in which:

DETAILED DESCRIPTION OF THE INVENTION

Figure 1:
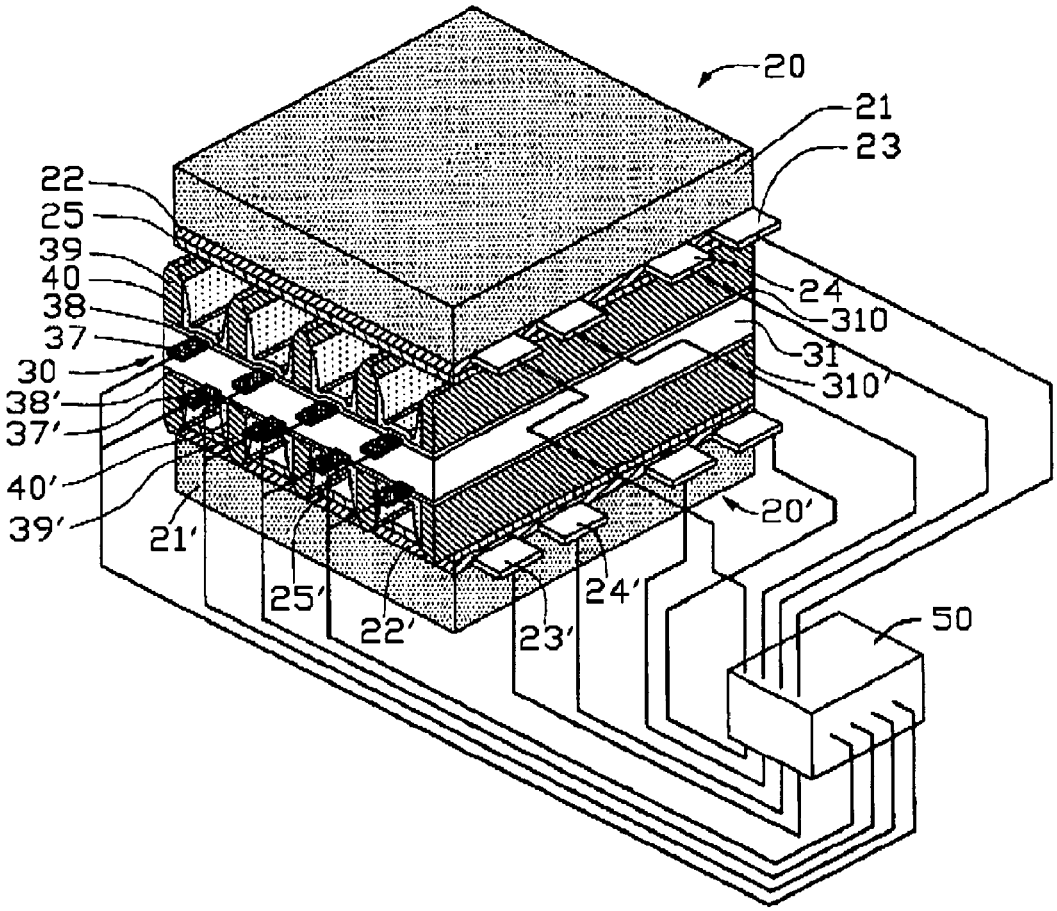
FIG. 1 is an enlarged, isometric view of part of a double-faced plasma display panel of the present invention.

Referring to FIG. 1, a double-faced plasma display panel (not labeled) of a display panel assembly of the present invention comprises two parallel viewing screens 20, 20', and a discharge structure 30 located between the viewing screens 20, 20'. The viewing screen 20 comprises a transparent substrate 21, with a plurality of transparent scanning electrodes 24, a plurality of transparent displaying electrodes 23, a transparent dielectric layer 22, and a protection layer 25 formed at an inner surface (not labeled) of the transparent substrate 21. The scanning electrodes 24 and the displaying electrodes 23 are alternately arranged on the inner surface of the transparent substrate 21, and are each aligned in a first horizontal direction. The transparent dielectric layer 22 covers the transparent scanning electrodes 24 and the transparent displaying electrodes 23, so that the transparent scanning electrodes 24 and the transparent displaying electrodes 23 are embedded in the transparent dielectric layer 22. The protection layer 25 covers the transparent dielectric layer 22.

The viewing screen 20' has substantially the same structure as that of the viewing screen 20. The viewing screen 20' comprises a transparent substrate 21', with a plurality of transparent scanning electrodes 24', a plurality of transparent displaying electrodes 23', a transparent dielectric layer 22', and a protection layer 25' formed at an inner surface (not labeled) of the transparent substrate 21'. The scanning electrodes 24' and the displaying electrodes 23' are alternately arranged on the inner surface of the transparent substrate 21', and are each aligned in the first horizontal direction. The transparent dielectric layer 22' covers the transparent scanning electrodes 24' and the transparent displaying electrodes 23', so that the transparent scanning electrodes 24' and the transparent displaying electrodes 23' are embedded in the transparent dielectric layer 22'. The protection layer 25' covers the transparent dielectric layer 22'.

The discharge structure 30 located between the viewing screens 20, 20' comprises an opaque insulative substrate 31 as a central plane thereof. The opaque insulative substrate 31 comprises two opposite surfaces 310, 310'. Each surface 310, 310' generally faces the corresponding viewing screen 20, 20'. A plurality of addressing electrodes 37, an opaque dielectric layer 38, a plurality of separation walls 39 and a fluorescent layer 40 are formed at the surface 310 of the opaque insulative substrate 31. The addressing electrodes 37 are arranged on the surface 310, and are each aligned in a second horizontal direction, which is perpendicular to the first horizontal direction. The opaque dielectric layer 38 covers the addressing electrodes 37, so that the addressing electrodes 37 are embedded in the opaque dielectric layer 38. The separation walls 39 extend up from the opaque dielectric layer 38, and are each aligned in the second horizontal direction. Each separation wall 39 generally separates two adjacent addressing electrodes 37. That is, each addressing electrode 37 is positioned under a gap (not labeled) defined between two adjacent separation walls 39. The fluorescent layer 40 is coated on exposed regions (not labeled) of the opaque dielectric layer 38 and side faces (not labeled) of the separate walls 39. The fluorescent layer 40 comprises three primary colors, such as red, green and blue.

Similarly, a plurality of addressing electrodes 37', an opaque dielectric layer 38', a plurality of separation walls 39' and a fluorescent layer 40' are formed at the surface 310' of the opaque insulative substrate 31. The addressing electrodes 37' are arranged on the surface 310', and are each aligned in the second horizontal direction. The opaque dielectric layer 38' covers the addressing electrodes 37', so that the addressing electrodes 37' are embedded in the opaque dielectric layer 38'. The separation walls 39' extend down from the opaque dielectric layer 38', and are each aligned in the second horizontal direction. Each separation wall 39' generally separates two adjacent addressing electrodes 37'. That is, each addressing electrode 37' is positioned above a gap (not labeled) defined between two adjacent separation walls 39'. The fluorescent layer 40' is coated on exposed regions (not labeled) of the opaque dielectric layer 38' and side faces (not labeled) of the separation walls 39'. The fluorescent layer 40' comprises three primary colors, such as red, green and blue.

Figure 2:
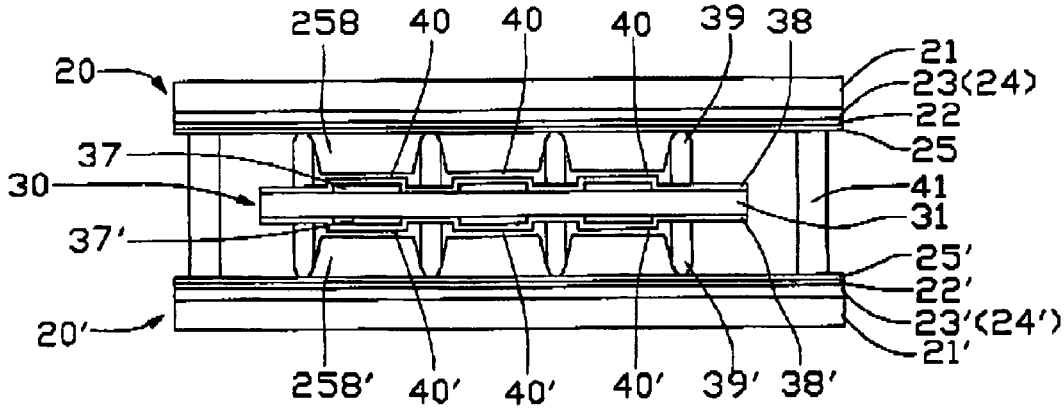
FIG. 2 is essentially a schematic side plan view of the plasma display panel of FIG. 1.

FIG. 2 is essentially a schematic side plan view of the double-faced plasma display panel shown in FIG. 1. The protection layer 25 and the opaque dielectric layer 38 cooperatively define a discharge space 258, and the protection layer 25' and the opaque dielectric layer 38' cooperatively define a discharge space 258'. Because of the opaque dielectric layer 38 and the opaque dielectric layer 38', the discharge space 258 and the discharge space 258' are independent of each other. A discharge gas is filled within the discharge space 258 and the discharge space 258'. The discharge gas is selected from the group consisting of helium gas, neon gas, xenon gas, argon gas, and any mixture thereof. Furthermore, four side walls 41 are mounted between four opposite side extremities of the protection layers 25, 25'. The side walls 41 are used to support the protection layers 25, 25', and maintain the protection layers 25, 25' a certain distance apart.

For the viewing screen 20, there are two kinds of configurations for the electrodes 23, 24, 37. The first configuration is as follows. The addressing electrodes 37 are regarded as row electrodes, and the scanning electrodes 24 and the displaying electrodes 23 are regarded as column electrodes. The second configuration is as follows. The scanning electrodes 24 and the displaying electrodes 23 are regarded as row electrodes, and the addressing electrodes 37 are regarded as column electrodes. The interconnections of the electrodes 23, 24, 37 in the two configurations are similar. In the preferred embodiment, the first configuration is adopted. Similarly, for the viewing screen 20', a configuration analogous to the first configuration is adopted for the electrodes 23', 24', 37'.

Figure 3:
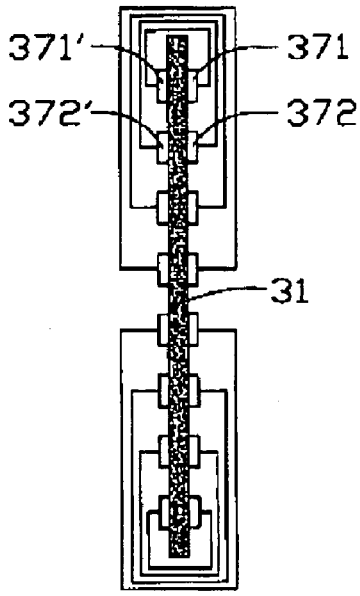
FIG. 3 is essentially a schematic, side plan diagram of an opaque insulative substrate and addressing electrodes of the plasma display panel of FIG. 1, showing these parts tilted to a vertical orientation, and showing connections of the addressing electrodes when they are regarded as row electrodes.
Figure 4:
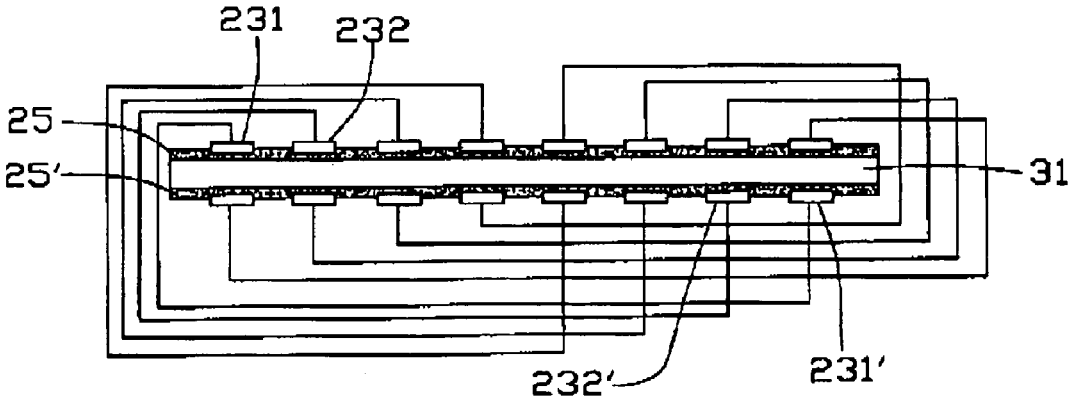
FIG. 4 is essentially a schematic, side plan diagram of the opaque insulative substrate, protection layers and displaying electrodes of the plasma display panel of FIG. 1, showing connections of the displaying electrodes when they are regarded as column electrodes.
Figure 5:
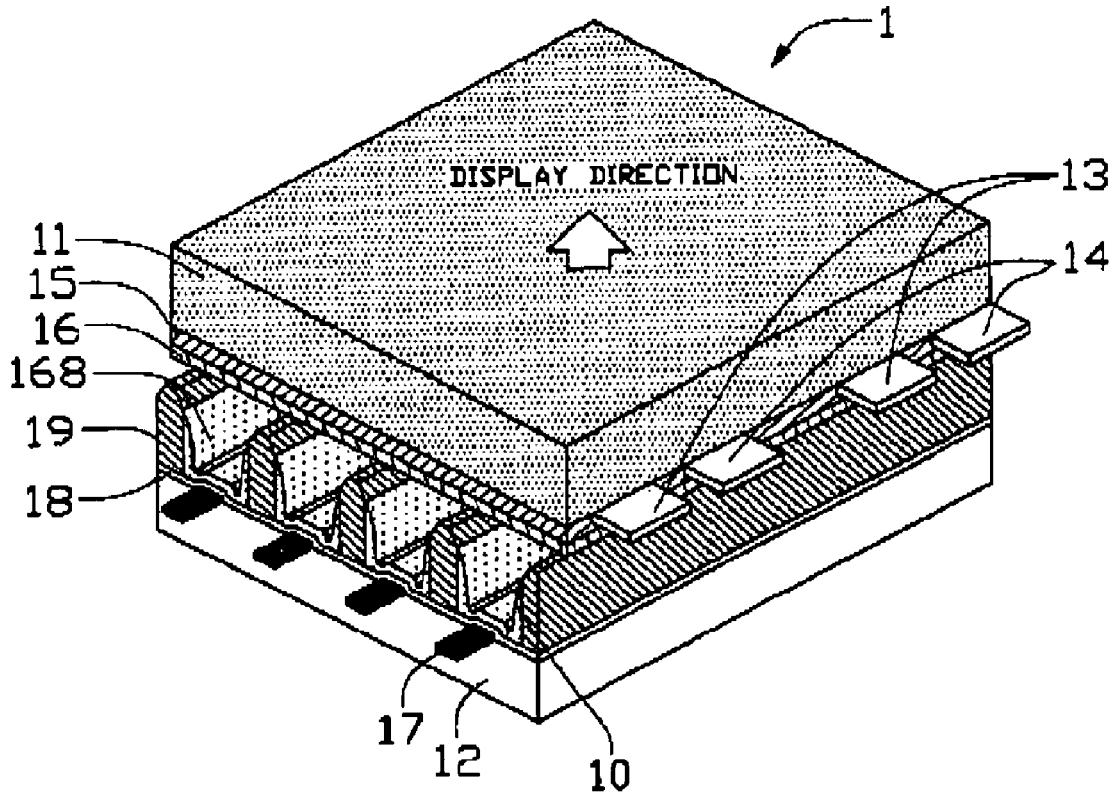
FIG. 5 (PRIOR ART)
FIG. 5 is an isometric view of part of a conventional plasma display panel.

FIG. 3 is a schematic diagram showing connections of row addressing electrodes 37, 37'. The addressing electrodes 37, 37' at a first row are labeled as 371, 371', and the addressing electrodes 37, 37' at a second row are labeled as 372, 372'. The addressing electrodes 371, 371' are electrically interconnected, and the addressing electrodes 372, 372' are electrically interconnected. Similarly, other addressing electrodes 37,37' at same rows are electrically interconnected. FIG. 4 is a schematic diagram showing connections of column displaying electrodes 23, 23', and similar connections of column scanning electrodes 24, 24' are not shown. Regarding the column displaying electrodes 23, 23', a first pair of column displaying electrodes 23, 23' which are axially symmetrical to a center of the opaque insulative substrate 31 are labeled as 231, 231', and a second pair of column displaying electrodes 23, 23' which are axially symmetrical to the center of the opaque insulative substrate 31 are labeled as 232, 232'. The displaying electrodes 231, 231' are electrically interconnected, and the displaying electrodes 232, 232' are electrically interconnected. Similarly, other pairs of column displaying electrodes 23, 23' which are axially symmetrical to the center of the opaque insulative substrate 31 are electrically interconnected.

A single driving system 50 is applied in the plasma display panel. The addressing electrodes 37, 37', the displaying electrodes 23, 23', and the scanning electrodes 24, 24'are electrically connected to the single driving system 50 respectively. When a voltage applied between the displaying electrodes 23 and the scanning electrodes 24 is more than the starting voltage, the discharge gas in the discharge space 258 discharges and generates ultraviolet rays. The ultraviolet rays irradiate the fluorescent layer 40, and the fluorescent layer 40 luminesces in accordance with the three primary colors thereof. Thus visible light is emitted from an outer surface of the transparent substrate 21, and a first image is displayed on the viewing screen 20.

Similarly, the discharge gas in the discharge space 258' discharges and generates ultraviolet rays. The ultraviolet rays irradiate the fluorescent layer 40', and the fluorescent layer 40' luminesces in accordance with the three primary colors thereof. Thus visible light is emitted from an outer surface transparent substrate 21', and a second image the same as the first image is displayed on the viewing screen 20'.

Compared with a conventional plasma display panel, the plasma display panel of the present invention adopts a pair of viewing screens 20, 20', and a single driving system to simultaneously display same images at the two viewing screens 20, 20'. Therefore, the plasma display panel has a simple structure, a small size, and a low cost. This enables the plasma display panel to be advantageously applied in traffic signal boards, large-scale display boards, surround cinemas, and so on.

It is to be understood that the above-described apparatus is intended to illustrate rather than limit the invention. Variations may be made to the apparatus without departing from the spirit of the invention. It is appropriate that the appended claims be construed broadly and in a manner consistent with the scope of the invention.

We claim:

1. A double-faced plasma display panel comprising:

two parallel viewing screens, each viewing screen comprising a transparent substrate, with a plurality of transparent scanning electrodes and transparent displaying electrodes, a transparent dielectric layer, and a protection layer formed at an inner surface of the transparent substrate in turn;

a discharge structure located between the viewing screens, the discharge structure comprising an opaque insulative substrate having two opposite surfaces, each surface having a plurality of addressing electrodes, an opaque dielectric layer, a plurality of separation walls, and a fluorescent layer formed thereat in turn; and a discharge gas filled within spaces defined between the discharge structure and the viewing screens;

wherein pairs of the scanning electrodes symmetrically opposite each other across the opaque insulative substrate are electrically interconnected, pairs of the displaying electrodes symmetrically opposite each other across the opaque insulative substrate are electrically interconnected, and pairs of the addressing electrodes symmetrically opposite each other across the opaque insulative substrate are electrically interconnected; and the double-faced plasma display panel is configured with a single driving system to simultaneously display the same images at the two viewing screens, the single driving system is electrically connected to the scanning electrodes, the displaying electrodes of each viewing screen, and the addressing electrodes of the discharge structure.

2. The double-faced plasma display panel as claimed in claim 1, wherein the scanning electrodes and the displaying electrodes are alternately arranged on the inner surface of the transparent substrate, and are each aligned in a first horizontal direction.

3. The double-faced plasma display panel as claimed in claim 2, wherein the addressing electrodes are arranged on said each surface of the opaque insulative substrate, and are each aligned in a second horizontal direction which is perpendicular to the first horizontal direction.

4. The double-faced plasma display panel as claimed in claim 1, wherein the opaque dielectric layer covers the addressing electrodes.

5. The double-faced plasma display panel as claimed in claim 4, wherein the separation walls are formed at the opaque dielectric layer, and are each aligned in the second horizontal direction.

6. The double-faced plasma display panel as claimed in claim 5, wherein each separation wall separates two adjacent addressing electrodes.

7. The double-faced plasma display panel as claimed in claim 6, wherein the fluorescent layer is coated on exposed regions of the opaque dielectric layer and side faces of the separation walls,

8. The double-faced plasma display panel as claimed in claim 1, wherein the discharge gas is selected from the group consisting of helium gas, neon gas, xenon gas, argon gas, and any mixture thereof.

9. The double-faced plasma display panel as claimed in claim 1, wherein four side walls are mounted between opposite side extremities of the protection layers.

10. The double-faced plasma display panel as claimed in claim 3, wherein each pair of the scanning electrodes which are axially symmetrical with respect to a center point of the opaque insulative substrate are electrically interconnected, each pair of the displaying electrodes which are axially symmetrical with respect to the center point of the opaque insulative substrate are electrically interconnected, and each pair of the addressing electrodes which are symmetrical with respect to a center plane of the opaque insulative substrate are electrically interconnected.

11. The double-faced plasma display panel as claimed in claim 3, wherein each pair of the scanning electrodes which are symmetrical with respect to a center plane of the opaque insulative substrate are electrically interconnected, each pair of the displaying electrodes which are symmetrical with respect to the center plane of the opaque insulative substrate are electrically interconnected, and each pair of the addressing electrodes which are axially symmetrical with respect to a center point of the opaque insulative substrate are electrically interconnected.

12. A display panel assembly comprising:

two viewing screens parallel spaced from each other, each of said two viewing screens comprising a plurality of electrodes attached thereto;

a discharge structure located between said two viewing screens and having another plurality of electrodes attached to two opposite sides of said discharge structure respectively and facing said two viewing screens respectively, a plurality of separate discharge spaces formed between said discharge structure and said each of said two viewing screens respectively, wherein each of said another plurality of electrodes formed on a first side of said two opposite sides of said discharge structure is electrically connected to a respective electrode of said another plurality of electrodes which is formed on a second aide of said two opposite sides of said discharge structure and which is located symmetrically to said each of said another plurality of electrodes formed on said first side with respect to a central plane of said discharge structure; and discharge gas disposed in each of said plurality of separate discharge spaces so as to perform light emission by means of electrifying said plurality of electrodes of said two viewing screens and said another plurality of electrodes of said discharge structure respectively, said plurality of electrodes of said two viewing screens and said another plurality of electrodes each of which on said first side is electrically connected to said respective electrode of said another plurality of electrodes on said second side are commonly driven by a single system for displaying the same images at said two viewing screens, and the single system is electrically connected to said plurality of electrodes of said two viewing screens and said another plurality of electrodes of said discharge structure.

13. The display panel assembly as claimed in claim 12, wherein said plurality of electrodes of said two viewing screens and said another plurality of electrodes each of which on said first side is electrically connected to said respective electrode of said another plurality of electrodes on said second side are commonly driven by a single system for displaying the same image at said two viewing screens.

14. A display panel assembly comprising two viewing screens parallel spaced from each other, each of said two viewing screens comprising a plurality of electrodes attached thereto;

a discharge structure located between said two viewing screens and having another plurality of electrodes attached to two opposite sides of said discharge structure respectively and facing said two viewing screens respectively, a plurality of separate discharge spaces formed between said discharge structure and said each of said two viewing screens respectively, wherein each of said another plurality of electrodes formed on a first side of said two opposite sides of said discharge structure is electrically connected to a respective electrode of said another plurality of electrodes which is formed on a second side of said two opposite sides of said discharge structure and which is located symmetrically to said each of said another plurality of electrodes formed on said first side with respect to a central point of said discharge structure; and discharge gas disposed in each of said plurality of separate discharge spacers so as to perform light emission by means of electrifying said plurality of electrodes of said two viewing screens and said another plurality of electrodes of said discharge structure respectively, said plurality of electrodes of said two viewing screens and said another plurality of electrodes each of which on said first side is electrically connected to said respective electrode of said another plurality of electrodes on said second side are commonly driven by a single driving system for displaying the same images at said two viewing screens, and the single system is electrically connected to said plurality of electrodes of said two viewing screens and said another plurality of electrodes of said discharge structure.

15. The display panel assembly as claimed in claim 14, wherein each of said plurality of electrodes formed on a first viewing screen of said two viewing screens is electrically connected to a respective electrode of said plurality of electrodes which is formed on a second viewing screen of said two viewing screens and which is located symmetrically to said each of said plurality of electrodes formed on said first viewing screen with respect to a central plane of said discharge structure.

* * * * *